US011738226B1

(12) United States Patent
Shah

(10) Patent No.: US 11,738,226 B1
(45) Date of Patent: Aug. 29, 2023

(54) TRAMPOLINE MONITORING AND ALERT SYSTEM

(71) Applicant: Darsh Shah, Prospect, KY (US)

(72) Inventor: Darsh Shah, Prospect, KY (US)

( * ) Notice: Subject to any disclaimer, the term of this patent is extended or adjusted under 35 U.S.C. 154(b) by 0 days.

(21) Appl. No.: 17/681,974

(22) Filed: Feb. 28, 2022

Related U.S. Application Data

(60) Provisional application No. 63/159,507, filed on Mar. 11, 2021.

(51) Int. Cl.
*A63B 5/11* (2006.01)

(52) U.S. Cl.
CPC ..... *A63B 5/11* (2013.01); *A63B 2220/52* (2013.01); *A63B 2220/833* (2013.01); *A63B 2225/50* (2013.01)

(58) Field of Classification Search
CPC ..... A63B 2220/52; A63B 2220/833; A63B 2225/50
See application file for complete search history.

(56) References Cited

U.S. PATENT DOCUMENTS 3,853,191 A * 12/1974 Yamagiwa ..... G01G 19/46 341/1
4,489,933 A * 12/1984 Fisher ..... A63B 5/11 482/28
4,709,307 A * 11/1987 Branom ..... A41D 27/085 362/108
5,190,491 A * 3/1993 Connelly ..... A63H 33/26 446/236
7,297,089 B2 * 11/2007 Chen ..... A63B 69/0053 482/1
7,572,206 B2 * 8/2009 Wilkins ..... A63B 5/20 482/8
8,206,266 B2 * 6/2012 Hall ..... A63B 24/0003 482/901
8,371,991 B2 * 2/2013 Chen ..... A63B 41/00 172/135
8,585,558 B2 * 11/2013 Chen ..... A63B 69/0053 482/28
9,700,748 B2 * 7/2017 Howe ..... G04F 8/00
10,124,200 B2 * 11/2018 Chen ..... A63B 5/11
10,391,359 B2 * 8/2019 McGrane ..... A63B 24/0003
10,794,895 B2 10/2020 Xie
10,828,550 B2 * 11/2020 Liang ..... A63B 71/0622
11,058,916 B2 7/2021 McGrane et al.
11,458,398 B2 * 10/2022 Chen ..... A63F 13/2145
2004/0058787 A1 * 3/2004 Lin ..... A63B 69/34 482/84

(Continued)

FOREIGN PATENT DOCUMENTS

CN 204891049 U 7/2015

*Primary Examiner* — Garrett K Atkinson
(74) *Attorney, Agent, or Firm* — Law Office of J.L. Simunic; Joan Simunic

(57) ABSTRACT

The present development is an integrated trampoline jumping mat. The trampoline mat has a sensor or a set of sensors, a processor with wireless communication unit, and a smart device with an application program running that is in communication with the sensors. The sensors are selected to determine weight on the mat, number of people on the mat, elasticity of the mat, and degree of wetness of the mat. Data collected by the sensors is recorded and manipulated in the processor, and then transmitted to the smart device.

10 Claims, 1 Drawing Sheet

(56) References Cited

U.S. PATENT DOCUMENTS

| | | | | |
|---|---|---|---|---|
| 2005/0043122 | A1* | 2/2005 | Publicover | A63B 71/06 473/465 |
| 2006/0135320 | A1* | 6/2006 | Chen | A63B 5/11 482/8 |
| 2006/0135321 | A1* | 6/2006 | Chen | A63B 5/11 482/8 |
| 2011/0034300 | A1* | 2/2011 | Hall | A63B 24/0003 482/29 |
| 2012/0295763 | A1* | 11/2012 | Lin | A63B 5/11 482/4 |
| 2012/0302407 | A1* | 11/2012 | Kelliher | A63B 21/222 482/110 |
| 2013/0072269 | A1* | 3/2013 | Chen | A63B 63/00 463/7 |
| 2016/0096055 | A1* | 4/2016 | Smock | A63B 71/022 482/27 |
| 2017/0144052 | A1* | 5/2017 | Liang | A63B 5/11 |
| 2018/0133530 | A1* | 5/2018 | Chen | A63F 9/0291 |
| 2020/0271685 | A1* | 8/2020 | Varone | G01R 33/0206 |
| 2021/0387034 | A1* | 12/2021 | Hall | A63B 5/11 |
| 2022/0134233 | A1* | 5/2022 | Chen | A63F 13/2145 463/36 |
| 2022/0409942 | A1* | 12/2022 | Chen | A63B 24/0087 |

* cited by examiner

TRAMPOLINE MONITORING AND ALERT SYSTEM

CROSS-REFERENCE TO PRIOR APPLICATIONS

The present application claims priority to U.S. 63/159,507 filed 11 Mar. 2021, which is incorporated herein in its entirety by reference.

GOVERNMENT SUPPORT

The invention disclosed here was made without government support.

FIELD OF THE INVENTION

The invention relates to a monitoring and alert system for use with a trampoline.

BACKGROUND OF THE INVENTION

Trampoline systems include weight limits to ensure that the trampoline bed does not collapse during use which can cause injury to the user(s). However, it is not uncommon for several people, often children, to try to use a trampoline concurrently. This can result in collisions, which can cause head injuries or other soft-tissue injuries. Thus, it would be beneficial to have some type of alert if the weight limit for the trampoline has been exceeded. Moreover, it would be convenient to have the alert sound not only on or near the trampoline, but to also send a wireless notification to a receiver, such as a cellphone, so an interested party could be aware that the weight limit has been exceeded even if the interested party is not in the immediate vicinity of the trampoline.

In addition, a common trampoline injury is "trampoline ankle" or an ankle sprain, which may be accompanied by fractures of the foot and/or ankle, caused by ligament overstretch from a sudden or twisted movement when the foot rolls over. This type of injury can occur from collision with another trampoline user or by a single user who hits the trampoline bed at an incorrect angle. The risk for such an injury increases when the trampoline bed is slippery, such as when the bed is wet. Because trampolines are often located in outdoor or open-air environments, dew or light mist can make the trampoline bed dangerous to use without the danger being visible to the naked eye. Thus, it be beneficial to have some type of sensor to detect if the bed had a certain level of dampness and to alert a user of the potential risk. In one embodiment, a single sensor system would detect trampoline bed dampness, trampoline bed fabric degradation and trampoline bed load, and would provide the information to designated recipients

SUMMARY OF THE PRESENT INVENTION

The present development is a monitoring and alert system for use with a trampoline to send out an alert when the weight limit of the trampoline has been exceeded and/or when the surface of the trampoline is wet, including moisture from dew or misting, and/or if the integrity of the trampoline bed has been compromised, including weak spots or elasticity reduction due to fabric degradation.

DETAILED DESCRIPTION OF THE PRESENT DEVELOPMENT

The present invention relates to a monitoring and alert system for determining if the number of jumpers or the total weight on a trampoline mat has exceeded a predetermined value and/or if the mat surface is wet and/or if the integrity of the mat has been compromised. The monitoring system of the present invention comprises (a) a smart trampoline jumping mat that comprises a sensor or a set of sensor, (b) a processor with wireless communication unit, and (c) a smart device with an application program running that is in communication with the sensors. The sensors are selected to determine weight on the mat, number of people on the mat, degree of wetness of the mat, elasticity of the mat, or a combination thereof. Data collected by the sensors is recorded and manipulated in the processor, and then transmitted to the smart device.

Figure 1:
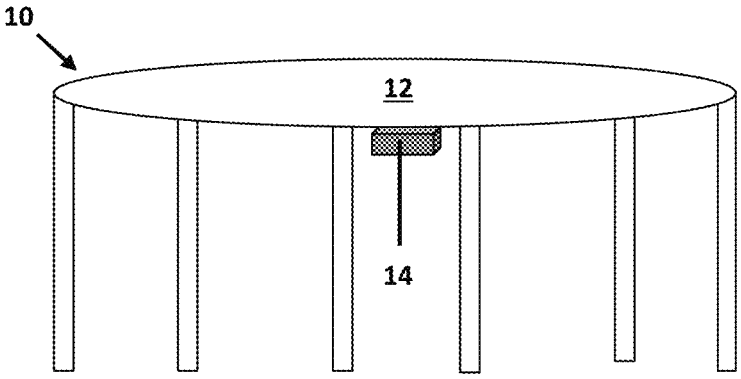
FIG. 1 shows a trampoline bed with an inbuilt sensor made according to the present invention.
Figure 2:
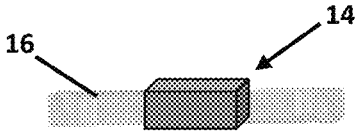
FIG. 2 shows the sensor and elastic belt of the trampoline bed of FIG. 1; and, FIG. 3 is a schematic showing the wireless connectivity of the sensor of the trampoline bed of FIG. 1 and the alert device set to receive data from the trampoline bed.

As shown in FIGS. 1 and 2, the monitoring and alert system 10 comprises a sensor 14 affixed to the trampoline jumping mat 12. Optionally, the sensor may be integrated into the jumping mat, such as being affixed within the netting of the mat 12 or integrated within the trampoline mat material. The sensor 14 is selected to detect weight on the mat or location of deflections to the surface of the mat or degree of moisture on the surface of the mat or degree of elasticity of the mat or a combination thereof. Optionally, multiple sensors may be used with each sensor detecting a different input, i.e. a first sensor to detect weight, a second sensor to detect to deflections, and a third sensor to detect moisture. The sensor collects data for the parameter it is selected to detect, records the data, and then sends the data to the processor. In an exemplary embodiment, as shown in FIG. 2, the sensor 14 comprises a load sensor to measure weight on the trampoline mat 12, and a moisture sensor to measure the wetness of the trampoline mat 12, and an elastic belt 16 to measure the elasticity of the trampoline mat 12. In a preferred embodiment, a device having wireless communication abilities is attached under the trampoline mat 12—on the face opposing the jumping surface—to convert analog sensor data to digital sensor data.

Figure 3:
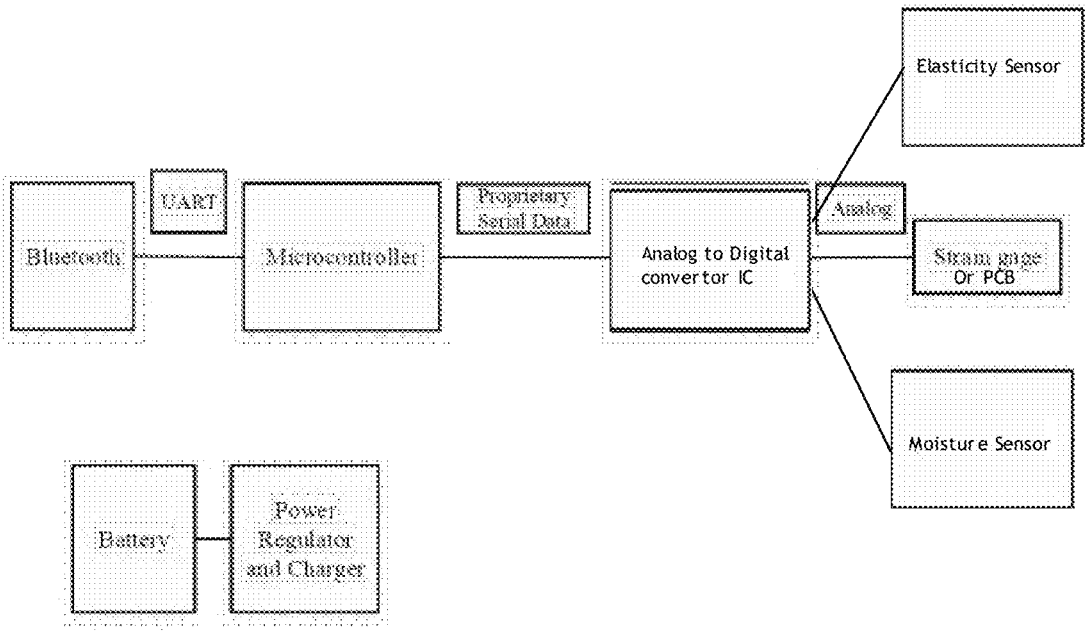

The processor is the link between the sensors and the smart device. The sensors may be in wireless communication with the processor or may be directly connected to the processor. The processor records the data and manipulates the data to calculate a current status value using a program in the processor. An exemplary schematic showing the link between the sensor(s) and the smart device is shown in FIG. 3, wherein one or more sensors detect elasticity or strain on the trampoline mat or moisture on the trampoline mat as analog input, and then convert the analog input to digital data, and then the digital data is analyzed in a microprocessor using a predetermined program, and then the analyzed data is transmitted to smart device. As is known in the art, a universal asynchronous receiver-transmitter (UART) may be used to facilitate the transfer of information from the microprocessor to the smart device.

The data manipulation process may include filtering the data, removing sensor noise, and collating data points. For example, the trampoline jumping mat 12 may have affixed to it a first sensor to detect weight or strain on the mat, a second sensor to detect to deflections, and a third sensor to detect moisture. The processor is programmed to gather data from the weight sensor and the deflections sensor and the moisture sensor, and to calculate a current status value for weight and a current status value for deflections and a current status value for moisture. The processor is also programmed with a predetermined value for weight, a predetermined value for deflections, and a predetermined value for moisture. The current status value for weight is determined by calculating the difference in signals sent from the weight sensor when no object is on the jumping mat and when an object is present on the jumping mat. The difference is reported as a positive value for weight. The current status value for deflections is determined by calculating the difference in signals sent from the deflections sensor when no object is on the jumping mat and when at least one deflection is detected on the jumping mat surface, wherein a deflection is defined as a deformation of the jumping mat surface of at least 35° from a flat plane. The difference is reported as a positive value for deflection. The current status value for moisture is determined by calculating the difference in signals sent from the moisture sensor when the jumping mat surface is dry and when the jumping mat surface is not dry. The difference is reported as a positive value for moisture. A program in the processor then compares the current status value from the sensors with predetermined values. If the current status value exceeds the predetermined value, the data is flagged with a warning. The manipulated data is transmitted to the smart device.

The smart device can be any processor that can receive and display data, such as a smart phone or an electronic tablet or a computer. The smart device is preprogrammed with an App program designed to display the current status values received from the processor. In a preferred embodiment, any data that is flagged by the processor is displayed on the smart device as a warning or similar alert notice. Optionally, the App may store the current status values in the smart device or may allow for uploading and downloading the data from a cloud service.

In an exemplary embodiment, the predetermined values for the current status values are entered into the processor from the smart device. For example, for a trampoline jumping mat fitted with a weight sensor, a deflection sensor, and a moisture sensor, a parent can open the App on a smart phone and enter a weight limit of 250 lbs, a deflection limit of 8, a moisture limit of 3% and a direction to display flagged values with a vibration or flashing screen or a notification alert on the smart phone. Jumpers can then begin playing on the trampoline jumping mat and the sensors are activated. The processor gathers data from the sensors, manipulates the data, and compares it to the parent-entered values. If the weight on the jumping mat is determined to exceed 250 lbs, the processor sends the reading to the smart phone with a flag and the smart phone begins to vibrate or flash or show an alert notification or some combination thereof. Alternatively, if the weight is less than 250 lbs, but the deflections are calculated to be 10 deflections at a point in time—such as if too many children try to jump on the mat at the same time, the smart phone would vibrate and flash. Similarly, if the jumping mat gets wet from a lawn sprinkler, the moisture value would exceed 3% and the smart phone would vibrate and flash.

The monitoring system for use with a trampoline of the present invention is intended to make use of a trampoline jumping mat safer for the trampoline jumpers. By including sensors with real time feedback through smart devices, parents can monitor children's activities on a trampoline even when the trampoline is not within sight.

Unless defined otherwise, all technical and scientific terms used herein have the same meaning as commonly understood by one of ordinary skill in the art to which the presently disclosed subject matter pertains. Representative methods, devices, and materials are described herein, but are not intended to be limiting unless so noted. The terms "a", "an", and "the" refer to "one or more" when used in the subject specification, including the claims.

It is understood that, in light of a reading of the foregoing description, those with ordinary skill in the art will be able to make changes and modifications to the present invention without departing from the spirit or scope of the invention, as defined herein. For example, those skilled in the art may substitute the specific sensors cited herein for sensors that detect other quantifiable characteristics without altering the scope of the present invention.

What is claimed is:

1. A monitoring and alert system for use with a trampoline that comprises (a) a trampoline jumping mat that comprises at least one sensor, wherein the sensor collects data indicating weight on the jumping mat or degree of wetness of the jumping mat or elasticity of the jumping mat or a combination thereof; (b) a processor with a wireless communication unit that is in communication with the sensor, and wherein the sensor transmits the data collected by the sensor to the processor, and wherein the processor uses the data from the sensor to generate a current status value; and (c) a smart device with an application program miming that is in communication with the processor and wherein a predetermined value is entered into the processor from the smart device, and wherein the processor compares the current status value to the predetermined value, and wherein an alert notice is transmitted to the smart device if the current status value exceeds the predetermined value.

2. The system of claim 1 wherein the at least one sensor is affixed to the trampoline jumping mat.

3. The system of claim 1 wherein the at least one sensor is integrated into the trampoline jumping mat.

4. The system of claim 1 wherein the wireless communication unit is attached to the trampoline jumping mat.

5. The system of claim 1 wherein the smart device is a smart phone or an electronic tablet or a computer.

6. The system of claim 5 wherein the smart device is preprogrammed with an app program designed to display the current status value received from the processor.

7. The system of claim 6 wherein the app program displays the alert notice transmitted to the smart device.

8. The system of claim 7 wherein the alert notice is a device vibration or a device screen flash or a device display showing an alert notification or a combination thereof.

9. The system of claim 7 wherein the app stores the current status values in the smart device or in a cloud service.

10. The system of claim 6 wherein the app program includes a function to enter predetermined values for the current status values into the processor from the smart device.

* * * * *